United States Patent [19]

Tavernier et al.

[11] Patent Number: 4,761,357

[45] Date of Patent: Aug. 2, 1988

[54] ELECTROPHORETIC DEVELOPMENT OF ELECTROSTATIC CHARGE IMAGES

[75] Inventors: Serge M. Tavernier, Lint; Pierre R. De Roo, Schoten; Jozef L. Mampaey, Kontich; Robert F. Janssens, Geel, all of Belgium

[73] Assignee: AGFA-Gevaert N.V., Mortsel, Belgium

[21] Appl. No.: 29,882

[22] Filed: Mar. 25, 1987

[30] Foreign Application Priority Data

Apr. 1, 1986 [EP] European Pat. Off. ..... 86200541

[51] Int. Cl.[4] ..... G03G 13/10

[52] U.S. Cl. ..... 430/32; 430/34; 430/119; 430/38; 118/661

[58] Field of Search ..... 430/32, 35, 38, 117, 430/118, 119; 118/661

[56] References Cited

U.S. PATENT DOCUMENTS 3,949,116 4/1976 Lawson et al. ..... 430/118 X

*Primary Examiner*—J. David Welsh

*Attorney, Agent, or Firm*—William J. Daniel

[57] ABSTRACT

Electrophoretic process and apparatus for developing an electrostatic charge pattern carried by a dielectric surface by progressively moving that surface through a development station and simultaneously progressively advancing a layer of liquid toner (11) comprised of toner particles dispersed in a carrier liquid, through that station in proximity to said charge-carrying surface, (3), and imposing an electric field bias to cause or promote selective image-wise movement of toner particles through said liquid at said development station and deposition thereof on said charge-carrying surface in a pattern representing said electrostatic charge pattern, wherein said layer of liquid toner contains toner particles in a concentration of from 2 to 25% by weight, and including the step of applying a film of a substantially toner-free non-polar liquid which is miscible with the carrier liquid of said liquid toner and which has a specific conductivity lower than 0.2 nS/m over said liquid toner layer (11) in such manner and at such a rate that each increment of such toner layer arrives at the development station, substantially free from turbulence and covered by the film of substantially toner-free liquid, the thickness of the film being such that at the development station it just makes contact with the chargecarrying surface.

20 Claims, 3 Drawing Sheets

ELECTROPHORETIC DEVELOPMENT OF ELECTROSTATIC CHARGE IMAGES

DESCRIPTION present invention relates to the development of electrostatic charge patterns with a liquid developer comprising charged toner particles in a carrier liquid.

A survey of different methods for the production of electrostatic charge patterns on photoconductive electrically insulating recording materials and dielectric non-photoconductive recording materials is given e.g. in U.S. Pat No. 4,130,670. The development of electrostatic charge patterns by use of a liquid developer comprising an electrically insulating carrier liquid containing dispersed particles of a colouring substance (toner particles) which deposit on electrostatically charged areas by virtue of electrophoretic forces is described e.g. in U.S. Pat. No. 2,907,674.

Electrophoretic development can be accomplished by immersing the image surface in a bath of the liquid developer. Alternatively the developer liquid can be applied by means of a smooth surfaced roller rotating in a tray of the developer as described e.g. in U.S. Pat. No. 2,877,133.

The electrophoretic development of an electrostatic charge pattern resulting from image-wise exposure of an overall charged photoconductive layer can be a positive-positive development in which the toner image is formed by the deposition of toner particles responsive to electrostatic charges which remain following the exposure, or a reversal development, in which charges are induced in exposed areas by means of a development electrode to cause deposition of toner on those areas. In each form of development the toner particles are attracted to areas whose charge sign is opposite that of the polarity of the particles.

The charge value and the polarity of the toner particles can be conferred by means of so-called charge control agents of ionic nature. Such agents are to some extent dissolved in the carrier liquid and have the effect of lowering its resistivity. The greater the conductivity of the carrier liquid the more likely it is to diminish the strength of the electrostatic charges forming the image to be developed. This problem is the more serious when a concentrated toner developer is used wherein the conductive toner particles make mutual contact under thermal agitation.

UK patent application No. 2 041 790A refers to the problem of achieving a satisfactory electrophoretic development using a liquid developer with a high toner concentration and proposes a method wherein the liquid developer is applied as a film to the surface of an applicator roller which is rotated in such a position that it brings the film of liquid close to the surface carrying the charge pattern to be developed. The conductivity of the liquid and the thickness of the film are controlled so that only small amounts of liquid approximately corresponding to the field of the latent electrostatic image cross the gap between the film and the charge-carrying surface under the influence of the electrostatic charges. Electrophoresis continues after the developer liquid has made contact with the charge-carrying surface at a rate which is increased by the imposition of an electric field of opposite polarity to the charge of the latent electrostatic image. It is indicated that the method can be applied in plain paper copying machines to achieve a high production rate of copies which are substantially dry owing to the fact the entire surface of the photoconductor is not wetted with the developer liquid.

Another process of electrophoretic development wherein care is taken to avoid appreciable wetting of the electrostatic latent image-bearing surface by the carrier liquid of the toner developer is described in U.S. Pat. No. 4,021,586. The developer is applied with a transport member while an electric field is generated by means of a corona to depress the insulating carrier liquid before said transport member contacts the latent electrostatic image-bearing surface.

U.S. Pat. No. 4,504,138 refers to problems encountered during electrophoretic developing processes, including that of ensuring uniformity of the toner particle suspension fed to the photoconductive surface and the lack of versatility as to the type and concentration of the toner particles which can be employed. The patent proposes a process wherein development takes place by transfer of toner particles to the photoconductor surface from a thin viscous layer of toner particles containing insulating carrier liquid in a minimal amount sufficient to maintain the separate integrity of the particles. This process does not utilise the electrophoresis phenomenon. The toner particles transfer to the latent image carrier under the electric field of the latent image without having to move through the liquid. A viscous toner layer as described has a low electrical resistivity, and therefore the process-does not avoid the problem of diminution of the latent image field strength at the toner transfer point and consequent reduction of the developed image density. The low resistivity of the viscous toner layer furthermore opposes the creation of a biasing potential to prevent toner deposition on uncharged areas of the latent image-bearing surface.

In a patent specification of much earlier date : GB-P No. 1 118 812 which is in the name of Agfa-Gevaert AG and which was published in 1948, there is described a process wherein prior to electrophoretic development of a latent electrostatic image on the surface of a photoconductive layer by means of a liquid developer comprising pigment particles dispersed in a carrier liquid of high electric resistivity, the surface of the photoconductive layer is treated with a pigment-free organic liquid having a resistivity sufficiently high to prevent destruction of the latent electrostatic image and has a dipole moment of less than $0.3\times10^{-18}.\text{dyne}^{\frac{1}{2}}.\text{cm}^2$. The treatment leaves the photoconductor surface covered by a film of this liquid. It is indicated that because of the pre-coating of the photoconductor surface with the high resistivity liquid film, the electrophoretic developer can have a substantially higher pigment content than would otherwise be permissible for obtaining developed images of comparable quality. It is stated that with conventional electrophoretic processes, the pigment concentration in the developer is limited approximately to a maximum of about 0.5% by weight, since otherwise the pigment is also deposited at the image-free areas; whereas when the photoconductor surface is pre-coated as specified, developer liquid with a pigment concentration between 1 and 5% wt can be used.

GB-P No. 1 118 812 proposed the application of the high resistivity pigment-free liquid to the latent-image carrying photoconductive layer by dipping, wiping, brushing, spraying or a roller applicator and subsequent adjustment of the thickness of the liquid film, if necessary, e.g. by doctor blades or pressure rollers. In the case that the electrostatic image is formed on the surface of a rotating drum or belt subjected to repetitive charging, exposure and developing cycles as required in office document copiers, the addition of even one further treatment station for applying a liquid film to the drum or belt is impractical. To be effective the liquid film has to be of uniform and appropriate thickness on reaching the development station. Moreover it is difficult to avoid significant disturbance of the liquid toner layer at that station in consequence of movement of its surface into contact with the liquid film. Practical considerations make it particularly desirable for the pigment-free liquid of high electric resistivity and liquid developer to be brought to the developing station in the form of a liquid double layer on an applicator roller.

The present invention aims to provide an electrophoretic type developing process by which dense toner images can be formed and which can conveniently be applied in high speed copiers employing a rotating electrostatic image carrier which is subjected to charging, image-wise exposure and image development and transfer operations in each cycle. The invention also aims to provide an apparatus by means of which such a process can be performed, According to the present invention, there is provided an electrophoretic process of developing an electrostatic charge pattern carried by a dielectric surface by progressively moving that surface through a development station and simultaneously progressively advancing a layer of liquid toner comprised of toner particles dispersed in a carrier liquid, through that station in proximity to said charge-carrying surface, and imposing an electric field bias to cause or promote selective image-wise movement of toner particles through said liquid at said development station and deposition thereof on said charge-carrying surface in a pattern representing said electrostatic charge pattern, characterised in that said layer of liquid toner contains toner particles in a concentration of from 2 to 25% by weight and in that a substantially toner-free non-polar liquid which is miscible with the carrier liquid of said liquid toner and which has a specific conductivity lower than 0.2 nS/m is applied over the surface of said liquid toner layer in such manner and at such a rate that each increment of such toner layer arrives at the development station substantially free from turbulence and covered by an over-layer of said substantially toner-free liquid, the thickness of said over-layer being such that at the development station said over-layer just makes contact with the charge-carrying surface.

This process affords a combination of important advantages. It has been found that the application of the non-polar liquid over-layer to the liquid toner layer, thereby to form a liquid double-layer, is strongly conducive to the formation of good quality dense toner images. Unlike a process as described in GB 1 118 812, two liquid layers are not brought at the critical position where development into contact with each other at the critical position where development electrophoresis occurs. Rather the contact between moving surfaces which occurs at that position is between the surface of a liquid layer (the over-layer) and the surface of the electrostatic charge carrier. The liquid double-layer is formed and can acquire stability before the development station is reached. These factors may contribute to the very satisfactory results which the process provides.

Another important advantage of the process is that it can readily be performed in compact apparatus capable of fast repetitive copying work. The liquid toner layer and the over-layer can be formed on only one rotating applicator, the accommodation of which at the circumference of a photoconductor drum is not a problem.

In a preferred embodiment, in order to avoid as much as possible turbulence in the liquid toner layer, the layer of liquid toner covered by said over-layer of substantially toner-free liquid arrives at the development station in the same direction as the direction wherein the charge-carrying surface is moving. More preferably at the closest approach of the development station to the charge-carrying surface the relative movement of the approaching surfaces is substantially zero.

In a particularly preferred embodiment of the invention, the liquid toner and the liquid for forming the over-layer are extruded as from a slide hopper coater at substantially the same speed onto a rotatable applicator member from layer-forming channels whose exit slots are adjacent to each other and to that member. This procedure is recommended as one which readily enables the double-layer to be formed without causing any significant turbulence of the liquid toner layer. The extrusion of the layers can therefore if desired take place at a point quite close to the developing station. Preferably the liquid toner layer is extruded in a direction substantially tangential to the rotatable applicator or along a path which makes an included angle of less than 45° and preferably less than 30° with a plane which is tangential to the rotatable applicator at the point where the liquid toner layer first makes contact with that applicator. The features further contributes to the smooth and quick formation of a dynamically stable double-layer on the applicator. Preferably the liquids are extruded from their channels in substantially parallel directions because that condition also favours the foregoing result.

Preferably the gap, present at the development station, between the applicator carrying the liquid double-layer and the charge-carrying surface is in the range 10 to 100 μm. Very satisfactory performance of the process can most easily be achieved when observing this condition.

The overall thickness of the liquid double-layer is such that it just fills the aforesaid gap during the performance of the process. Preferably neither layer is above 50 μm in thickness. For the liquid toner layer the most preferred thickness range is 20 to 30 μm whereas for the over-layer the most preferred thickness range is 10 to 20 μm.

The speeds of the charge-carrying surface and the liquid double-layer are preferably equal. A small speed differential can be tolerated but the difference should not be more than 20%.

The biasing electric field influencing the electrophoretic development can be achieved by electrically biasing the applicator roller or other applicator member carrying the liquid double-layer, the applicator thereby forming a development electrode. Such member can e.g. be an electrically conductive member, having e.g. a resistivity smaller than $10^3$ ohm.cm. In positive-positive development of an electrostatic latent image formed by image-wise discharging an overall charged photoconductive layer, the biasing electrode is given a polarity opposite to that of electrostatic charges borne by the photoconductive or other dielectric surface prior to the development step. In reversal development the development electrode is given a bias of a polarity and magnitude such as to induce on said dielectric surface an electrostatic charge pattern which is in inverse (negative-positive or positive-negative) relationship to the electrostatic charge pattern conferred on said dielectric surface prior to the development step, and the development takes place by attraction of toner particles by the induced charges.

The invention is particularly suitable for use in the reversal development of half-tone images as is commonly required in the graphic arts field. The screen dots composing such images occupy a relatively small proportion of the whole copy area and the developed screened image is required to have a high contrast, with freedom from fog or background staining.

The invention includes apparatus for use in the electrophoretic development of electrostatic charge patterns. Apparatus according to the invention comprises a first rotatable member which has a dielectric surface for holding an electrostatic charge pattern, and a second rotatable member which has a surface on which a layer of developer liquid can be formed, said first and second rotatable members being mounted so as to define a gap therebetween capable of being bridged by liquid forming a layer on said second rotatable member, means for rotating said first and second members to cause their surfaces defining said gap to move preferably in the same direction therepast, means for producing an electrostatic charge pattern on the dielectric surface of said first rotatable member, liquid supplying means via which liquid toner comprising toner particles dispersed in a carrier liquid can be fed to the surface of said second rotatable member so as to form a liquid toner layer on that surface, and means for imposing an electric field bias across said gap to cause or promote selective image-wise movement of toner particles through said liquid at said gap and deposition of such particles on said charge-carrying surface in a pattern representing an electrostatic charge pattern on said dielectric surface, characterised in that in addition to said liquid toner supplying means there is a second liquid supplying means via which, without causing any significant turbulence of said liquid toner layer in the vicinity of said gap, a toner-free liquid can be supplied onto a layer of liquid toner supplied via said liquid toner supplying means so as to produce the result that each increment of a said liquid toner layer arriving at the said gap is covered by an over-layer of said toner-free liquid.

The gap defined by the surfaces of said first and second rotatable members is preferably in the range 10 to 100 μm. as hereinbefore stated in relation to a development process according to the invention.

Certain embodiments of the invention, selected by way of example, will now be described with reference to the accompanying diagrammatic drawings, in which certain proportions have been exaggerated for clarification.

Figure 1:
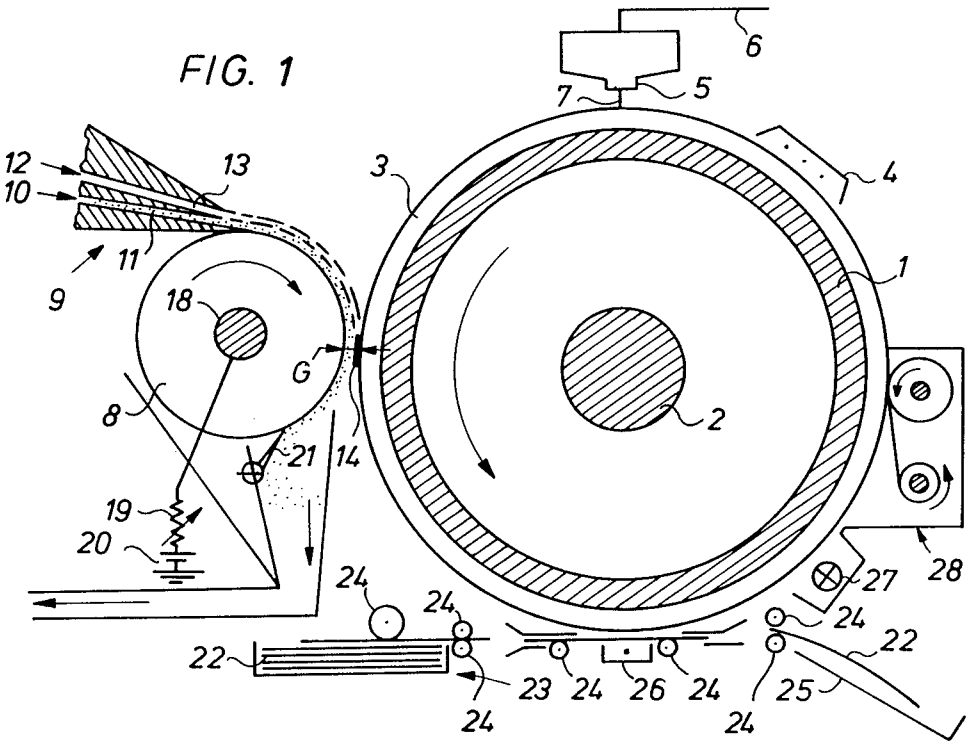
FIG. 1 represents a cross-sectional view of part of a document copying apparatus in which image development takes place by a process according to the present invention.

In FIG. 1 element 1 represents a conductive drum rotationally driven by its shaft 2. On said drum 1, e.g. made of aluminium, a photoconductive coating 3, e.g. made of vapour deposited photoconductive selenium or selenium alloy, is present. In a first step the photoconductive layer 3 is overall charged electrostatically with direct current corona source 4. Following the corona charging the photoconductive layer 3 is scanning-wise exposed by means of an array 5 of LED elements of which the light-output is controlled electronically by digital signals fed to the array by input lines 6 which are connected to the signal output of a character generator (not shown in the drawing). The photoconductive layer 3 passing the LED array 5 receives light rays 7 of tiny light spots corresponding with the individually light-emission modulated LED elements in the array 5 and is in that way discharged pattern-wise, e.g. at a resolution of 16 lines per mm.

Next to the LED exposure station follows a developing station operating according to the method of the present invention. Said developing station comprises an electrically conductive rotating applicator roller 8 above which there is a two-channel liquid applicator 9. Through a slotlike channel 10 of this applicator (slot-width not larger than 100 μm), a layer of concentrated toner dispersion 11 is fed substantially tangentially to the surface of roller 8. Simultaneously and at the same speed toner-free carrier liquid 13 is fed (via a parallel slotlike channel 12 of the applicator) on top of the toner dispersion. The applicator 9 is preferably made of steel elements that can be adjustably assembled to form the described channels 10 and 12. The feeding speed or output flow of said liquids, the peripheral speed of the applicator roller 8 and the thickness of said channels are such that a liquid double layer having a thickness in the range of 20 to 50 μm is formed on the applicator roller 8. It is suitable to use gear pumps for feeding the liquids. The two liquid layers, flow smoothly from the applicator 9 onto the roller 8 and the layers are substantially free of turbulence. It is important for the liquid toner layer to be substantially free of turbulence when it reaches the development station. The combined thickness of the layers is substantially equal to the thickness of the gap G (30 to 100 μm), so that the toner-free layer makes contact with the photoconductive layer 3 but there is no build-up of excess liquid in the gap. The toner is attracted through the liquid to form a dense image-forming deposit 14. The applicator roller 8 is made of conductive material, e.g. aluminium, and is connected through its shaft 18 to a direct current voltage source 20 via a variable resistor 19 set to give the desired voltage level. The polarity and magnitude of the voltage applied to the applicator roller can be selected suitably for positive-positive or reversal development.

End washers or spacer strips (not shown in the drawing) may be provided to keep the applicator roller 8 at the defined gap distance from the photoconductive drum surface 3.

Following the image-wise toner transfer the applicator roller 8 is freed from residual toner particles and carrier liquid by a scraper blade 21. Recovered toner and carrier liquid are collected in a receiver vessel (not shown in the drawing) for optional rejuvenation by adding pre-concentrated toner dispersion or are kept for rework in the factory.

Next to the developer station follows a toner image transfer station, as known in the art, which station comprises paper sheets 22 supplied by a paper sheet dispenser 23 conveyed by a series of conveyor rollers 24 towards a receiving tray 25. A transfer corona 26 applies to the rear of the toner receiving paper an electrostatic charge for attracting the toner image from the photoconductor layer 3 towards the receiving paper.

After the transfer of the toner image the photoconductive layer 3 is exposed overall with the light source 27 to remove residual charge. Residual toner is removed by the cleaning web device 28.

Figure 2:
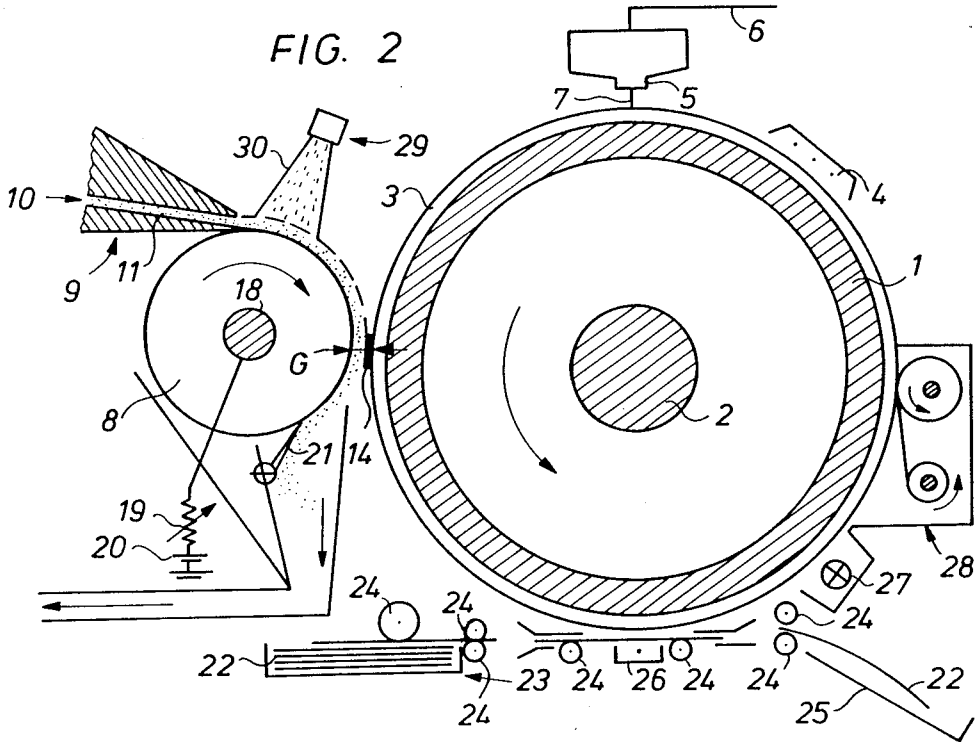
FIG. 2 represents a cross-sectional view of an alternative form of development station which can be used in carrying out the invention.

In FIG. 2 the apparatus is identical to the apparatus illustrated in FIG. 1 except for the manner of applying the substantially toner-free liquid. A concentrated toner dispersion is applied with a single-channel applicator 9 onto roller 8 and the toner-free liquid layer is formed on the toner dispersion layer by a spraying device 29 which projects a mist of tiny droplets (average particle size in the range of 0.1 to 10 μm) of non-polar toner-free insulating liquid as a spray cone 30, towards the concentrated toner dispersion layer carried by the applicator roller 8.

Figure 3:
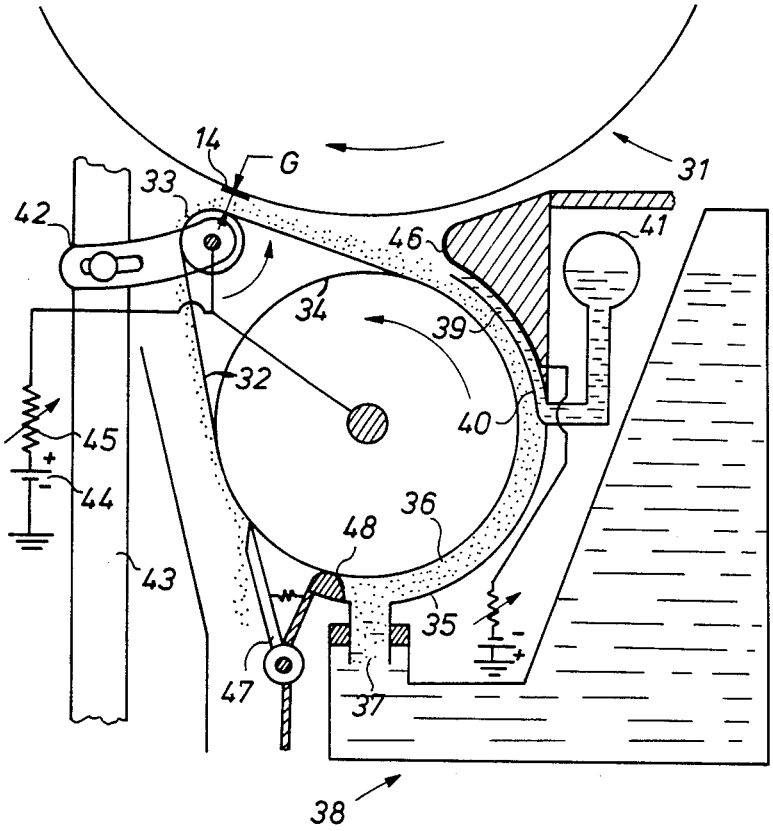
FIG. 3 represents a cross-sectional view of a third form of development station which can be used in carrying out the invention.

In another embodiment in FIG. 3, element 31 represents a rotating conductive drum having a dielectric layer carrying an electrostatic charge pattern, whereas the developing station operating according to the method of the present invention comprises an endless belt 32 carried and moved by rotating conveyor rollers 33 and 34. The conveyor roller 34 carrying the belt 32 forms with an arcuate member 35 made of electrically insulating material, e.g. epoxy resin or polymethyl methacrylate, a narrow channel 36 (thickness 20 to 50 μm) wherein concentrated toner dispersion 37 is introduced with a "chicken-feed", i.e., gravity operated, liquid feeding device 38. A second narrow channel 40 (thickness 10 to 20 μm) separated from the channel 36 by a separating wall 39 receives a toner-free non-polar electrically insulating liquid, which is supplied by a feeder device 41 incorporating a flow control means (not shown in the drawing). In the gap G (thickness 30 to 100 μm) the formed liquid double layer contacts with its toner-free liquid layer the dielectric layer of drum 31 carrying an electrostatic charge pattern. The conveyor rollers 33 and 34 and belt 32 are made of conductive material, e.g. stainless steel. The shaft of the conveyor roller 33 is adjustably mounted in a pair of supports 42 which are adjustably fitted to a frame member 43. The conveyor rollers 33 and 34 are through their shafts connected to a direct current voltage source 44 via a variable resistor 45 for controlling the voltage over the gap G applied to the carrier liquid. The rotation of the belt 32 and the capillary dimension of the channel 36 cause toner dispersion liquid to feed into the gap G wherein toner particles are attracted to form a dense deposit 14 on the charged dielectric member 31 in conformity with the charged areas.

A spring tensioned scraper blade 47 and a wiper cushion of resilient material 48 remove residual toner particles and carrier liquid which after filtration and treatment with an adsorber, e.g. highly porous silica or adsorbing carbon black, retaining dispersed and dissolved substances may be re-used.

In another embodiment of the present invention the substantially toner-free liquid, before and/or after application onto the toner dispersion layer is at its side remote from the toner dispersion layer provided with an electrostatic charge tending repel the toner particles, i.e. to force the toner particles toward the applicator surface carrying the liquid layers. Such embodiment is represented in FIG. 3 wherein one wall of the channel 40 is formed by an electrode 46 which contacts the substantially toner-free liquid and confers thereon an electric charge opposite in polarity to the toner particles contained in said toner concentrate dispersion. Hereby the toner particles are inhibited from reaching the outerface of the toner-free liquid layer before it reaches the gap G. In this way premature toner transfer and fog formation on residual charge in the exposed area of a photoconductor surface in positive-positive development are avoided.

For the same purpose, in another embodiment (not illustrated) the liquid layer carrier has an electrically insulating surface which is given, before being coated with the toner dispersion an electrostatic charge by corona thereby to attract the toner particles towards the carrier. For example, for carrying out such an embodiment, the apparatus of FIG. 3 operates with a dielectric belt of the type described in U.S. Pat. No. 4,021,586, e.g. belt 32 is a belt of electrically insulating organic polymer such as polyethylene terephthalate. In advance of the wiper means 48 (made of resilient electrically insulating material, e.g. silicone rubber) and downstream the scraper 47 a corona device applies an electrostatic charge onto the belt to produce electrostatic surface charges thereon before it becomes covered with the liquid toner.

In the above illustrated embodiments of liquid development the non-polar toner-free liquid is applied simultaneously with the toner dispersion layer in a very small gap having preferably a thickness in the range of 30 to 50 μm and over a very small angular area of the drum carrying the electrostatic charge pattern, so that in practice the transfer zone has a width not larger than 2 mm.

By a non-polar insulating liquid is meant a liquid having at 20° C. a dielectric constant lower than 3 and a specific conductivity at 20° C. lower than 0.2 n.S/m. The non-polar liquid used in any given process of the invention is preferably the same as the carrier liquid of the toner dispersion and is preferably a non-aromatic hydrocarbon liquid, e.g. an aliphatic hydrocarbon such as hexane, cyclohexane, iso-octane, heptane or isododecane, a fluorocarbon or a silicone oil. Thus, the insulating non-polar liquid is e.g. isododecane or a commercial petroleum distillate, e.g. a mixture of aliphatic hydrocarbons having a boiling range preferably between 150° C. and 220° C. such as the ISOPARS G. H. K and L (trade marks) of Exxon and SHELLSOL T (trade mark) of the Shell Oil Company.

The colouring substance used as the toner particles of the toner dispersion may be any inorganic pigment (said term including carbon) or solid organic dyestuff pigment commonly employed in liquid electrostatic toner compositions. Thus, for example, use can be made of carbon black and analogous forms thereof e.g. lamp black, channel black and furnace black e.g. RUSS PRINTEX 140 GEPERLT (trade-name of DEGUSSA - Frankfurt/M. W.Germany).

Typical solid organic dyestuffs are so-called pigment dyes, which include phthalocyanine dyes, e.g. copper phthalocyanines, metal-free phthalocyanine, azo dyes and metal complexes of azo dyes.

The following dyes in pigment form are given for illustration purposes only : FANALROSA B Supra Pulver (trade-name of Badische Anilin Soda-Fabrik AG, Ludwigshafen, Western Germany), HELIOGENBLAU LG (trade-name of BASF for a metal-free phthalocyanine blue pigment). MONASTRAL BLUE (a copper phthalocyanine pigment, C.I. 74,160). HELIOGENBLAU B Pulver (trade-name of BASF), HELI- OECHTBLAU HG (trade-name of Bayer AG, Leverkusen, Western Germany, for a copper phthalocyanine C.I. 74,160), BRILLIANT CARMINE 6B (C.I. 18,850) and VIOLET FANAL R (trade-name of BASF, C.I. 42,535).

Typical inorganic pigments include black iron (III) oxide and mixed copper (II) oxide/chromium(III) oxide/iron(III) oxide powder, milori blue, ultramarine cobalt blue and barium permanganate. Further are mentioned the pigments described in the French Patent Specification Nos. 1,394,061 filed Dec. 23, 1963 by Kodak Co., and 1,439,323 filed April 24, 1965 by Harris Int.Corp.

Preferred carbon black pigments are marked by DEGUSSA under the trade name PRINTEX. PRINTEX 140 and PRINTEX G (trade names for carbon blacks) are particularly suited as black toning agents. The characteristics of said carbon blacks are listed in the following Table.

TABLE

| | PRINTEX 140 | PRINTEX G |
|---|---|---|
| origin | channel black | furnace |
| density $g.cm^{-3}$ | 1.8 | 1.8 |
| grain size (measured by transmission electroscopy) | 29 nm | 51 nm |
| oil number (g of linseed oil adsorbed by 100 g of pigment) | 360 | 250 |
| specific surface (sq.m per g) | 96 | 31 |
| volatile material % by weight | 6 | 2 |
| pH | 5 | 8 |
| colour | brown-black | blue-black |

As colour corrector for the PRINTEX pigments preferably minor amounts of copper phthalocyanine are used, e.g. from 1 to 20 parts by weight with respect to the carbon black.

A toner dispersion developer composition for use according to the present invention can be prepared by using dispersing and mixing techniques well known in the art. It is conventional to prepare the dispersion by means of grinding or mixing apparatus, e.g. a 3-roll mill. a ball mill, a colloid mill or a high speed stirrer. A concentrate of e.g. 20% by weight of the solid materials selected for the developer in the insulating carrier liquid may be made in said devices and further insulating carrier liquid can subsequently be added thereto to provide a liquid toner developer having a concentration of toner particles higher than in common electrophoretic development wherein the concentration of toner particles normally does not exceed 1% by weight.

It is generally suitable for a ready-for-use electrophoretic liquid developer adapted for the present process, to incorporate the toner in an amount between 20 g and 250 g per litre, preferably between 50 g and 100 g per litre. The viscosity of said concentrated toner developers is in the range of 2 to 50 mPa.s measured at 25° C. and at a shear rate of 500 $s^{-1}$. The less concentrated developers used in common electrophoretic development having a toner concentration not exceeding 1 by weight have normally a viscosity four to five times less than the above given lowest value.

Liquid toner developers containing positively charged toner particles for use according to the present invention may be prepared as described in U.S. Pat. Nos. 3,909,433 and 4,525,446 and in published European patent application Nos. 0128244 and 0133628.

Liquid toner developers containing negatively charged toner particles for use according to the present invention may be prepared as described in European patent application No. 84201397.1 filed Oct. 2, 1984 by Agfa-Gevaert N.V. Belgium.

We claim:

1. In an electrophoretic process of developing an electrostatic charge pattern carried by a dielectric surface by progressively moving that surface through a development station and simultaneously progressively advancing a layer of liquid toner comprised of toner particles dispersed in a carrier liquid, through that station in proximity to said charge-carrying surface, and imposing an electric field bias to promote selective image-wise movement of toner particles through said liquid at said development station and deposition thereof on said charge-carrying surface in a pattern representing said electostatic charge pattern, the improvement wherein said layer of liquid toner contains toner particles in a concentration of from 2 to 25% by weight and including the step of applying a film of substantially toner-free non-polar liquid which is miscible with the carrier liquid of said liquid toner and which has a specific conductivity lower than 0.2 nS/m over the surface of said liquid toner layer in such manner and at such a rate that each increment of such toner layer arrives at the development station, substantially free from turbulence and covered by an overlying film of said substantially toner-free liquid, the thickness of said overlying film being such that at the development station said film just makes contact with the charge-carrying surface.

2. A process according to claim 1, wherein the liquid toner layer and the liquid overlying film arrive at the development station in the same direction as the direction wherein the charge-carrying surface is moving.

3. A process according to claim 1, wherein the liquid toner layer and the liquid overlying film are extruded onto the surface of an advancing endless applicator member from respective slots which are adjacent to each other and to that member.

4. A process according to claim 3, wherein the liquid toner layer is extruded in a direction substantially tangential to the applicator member or along a path which makes an included angle of less than 45° and preferably less than 30° with a plane which is tangential to the applicator member at the point where the liquid toner layer first makes contact with that applicator member.

5. A process according to claim 4, wherein the liquids are extruded from their slots in substantially parallel relation.

6. A process according to claim 3, wherein the gap present at the development station, between the surface of said applicator member and the charge-carrying surface is in the range of 1 to 100 μm.

7. A process according to claim 1, wherein neither said liquid toner layer or said overlying film has a thickness in excess of 50 μm.

8. A process according to claim 7, wherein the thickness of the liquid toner layer is from 20 to 30 μm and the thickness of the overlying film is from 10 to 20 μm.

9. A process according to claim 1, wherein said liquid toner layer and substantially toner-free film are carried by a roller or belt.

10. A process according to claim 1, wherein the dielectric surface carrying the electrostatic charge pattern is the surface of a photoconductive layer.

11. A process according to claim 1, wherein said liquid toner layer and said overlying film are carried to said development station by an electrically conductive member which is electrically charged for generating said electric field bias, said electrode having a polarity of opposite sign to that of an electrostatic charge pattern carried on said dielectric surface prior to the development station.

12. A process according to claim 11, wherein the electrical potential of the said charged member as to induce on said dielectric surface an electrostatic charge pattern which is in inverse (negative-positive or positive-negative) relationship to the electrostatic charge pattern carried on said dielectric surface prior to the development station, and wherein the development takes place by attraction of toner particles by the induced charges.

13. A process according to claim 1, wherein said electrostatic charge pattern represents a screened image.

14. A process according to claim 1, wherein the side of the overlying film which is opposite the liquid toner layer is provided with an electrostatic charge which tends to repel the toner particles in a direction away from the overlying film.

15. A process according to claim 1, wherein said liquid toner layer and said overlying film are carried to said development station by a carrier member whose surface is electrically insulating and wherein prior to the application of said liquid toner layer thereto, said insulating surface is electrostatically pre-charged with charges which exert attractive forces on the toner particles in said layer.

16. Apparatus for use in the electrophoretic development of electrostatic charge patterns, comprising a first endless member which has a dielectric surface for holding an electrostatic charge pattern, and a second endless member which has a surface on which a layer of developer liquid can be applied, said first and second endless members being mounted so as to define a gap therebetween capable of being bridged by a liquid layer on said second endless member, means for advancing said first and second members to cause their surfaces defining said gap to move in the same direction through the gap, means for producing an electrostatic charge pattern on the dielectric surface of said first member, a first liquid supplying means for feeding liquid toner comprising toner particles dispersed in a carrier liquid to the surface of said second member so as to form a liquid toner layer on that surface, means for imposing an electric field bias across said gap to promote selective image-wise movement of toner particles through said liquid at said gap and deposition of such particles on said charge-carrying surface in a pattern representing an electrostatic charge pattern on said dielectric surface, and a second liquid supplying means for delivering while said liquid toner layer remains free of significant turbulence in the vicinity of said gap, a film of toner-free liquid onto said layer of liquid toner whereby each increment of a said liquid toner layer arriving at the said gap is covered by said toner-free liquid film.

17. Apparatus according to claim 16, wherein the gap defined by the surfaces of said first and second endless members is in the range 10 to 100 $\mu$m.

18. Apparatus according to claim 16, wherein said liquid toner supplying means and said second liquid supplying means respectively comprise slots through which liquids can be extruded as layers, said slots being adjacent to each other and to said second endless member.

19. Apparatus according to claim 18, wherein that one of said slots which is nearer said second endless member defines a liquid flow path which is directed substantially tangentially to the surface of said second member or which intersects said surface at an included angle of less than 45° to a plane which is tangential to said surface at the line of intersection.

20. Apparatus according to claim 16, wherein said second liquid supplying means comprises means for spraying liquid onto a layer of liquid supplied via said liquid toner supplying means.

* * * * *